US007942510B2

(12) United States Patent
Shinada et al.

(10) Patent No.: US 7,942,510 B2
(45) Date of Patent: May 17, 2011

(54) LIQUID INJECTING METHOD AND LIQUID CONTAINER

(75) Inventors: Satoshi Shinada, Shiojiri (JP); Chiaki Miyajima, Matsumoto (JP); Masahide Matsuyama, Nagano-ken (JP); Yuichi Seki, Matsumoto (JP); Hisashi Koike, Suwa (JP); Taku Ishizawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 949 days.

(21) Appl. No.: 11/836,879

(22) Filed: Aug. 10, 2007

(65) Prior Publication Data

US 2008/0036808 A1 Feb. 14, 2008

(30) Foreign Application Priority Data

Aug. 11, 2006 (JP) ..... P2006-220755
Aug. 12, 2006 (JP) ..... P2006-220763

(51) Int. Cl.
*B41J 2/175* (2006.01)

(52) U.S. Cl. ..... 347/86

(58) Field of Classification Search ..... 347/7, 49, 347/85, 86
See application file for complete search history.

(56) References Cited

U.S. PATENT DOCUMENTS 5,721,576 A * 2/1998 Barinaga ..... 347/85
5,790,157 A * 8/1998 Higuma et al. ..... 347/85
6,036,305 A * 3/2000 Nagasaki et al. ..... 347/86
6,386,691 B1 5/2002 Liu
6,854,835 B2 * 2/2005 Kobayashi et al. ..... 347/85
6,905,199 B2 6/2005 Miyazawa et al.
7,293,866 B2 11/2007 Miyazawa et al.
7,635,180 B2 * 12/2009 Hattori et al. ..... 347/86
2002/0109760 A1 8/2002 Miyazawa et al.
2004/0239736 A1 12/2004 Miyazawa et al.
(Continued)

FOREIGN PATENT DOCUMENTS

EP 1164021 A2 12/2001
(Continued)

OTHER PUBLICATIONS

Extended European Search Report dated Feb. 24, 2009.

*Primary Examiner* — Anh T. N. Vo
(74) *Attorney, Agent, or Firm* — Sughrue Mion, PLLC

(57) ABSTRACT

A method of injecting a liquid into a liquid container detachably mounted on a liquid consuming device, the liquid container comprising: a liquid containing chamber containing the liquid; a liquid supply port connectable to the liquid consuming device; a liquid guide path for guiding the liquid contained in the liquid containing chamber to the liquid supply port; an air communicating path communicating the liquid containing chamber with air and having a communicating passage portion that is narrower than at least a part of other communicating paths in the air communicating path and can store some liquid contained in the liquid containing chamber by a meniscus; and a liquid residual quantity sensor provided in the liquid guide path for outputting different signals in accordance with a residual amount of the liquid in the liquid containing portion, wherein the liquid contained in the liquid containing chamber can be blocked from the air by the liquid stored in the communicating passage portion, the method comprising: forming an injection port on a more upstream side than an upstream end of the communicating passage portion; injecting a predetermined amount of liquid from the injection port; and sealing the injection port after injecting the liquid.

9 Claims, 13 Drawing Sheets

U.S. PATENT DOCUMENTS

| | | | | |
|---|---|---|---|---|
| 2005/0243110 | A1 | 11/2005 | Takahashi et al. | |
| 2007/0222833 | A1 | 9/2007 | Ishizawa et al. | |
| 2007/0229629 | A1 | 10/2007 | Miyazawa et al. | |
| 2008/0012914 | A1 | 1/2008 | Ishizawa et al. | |
| 2008/0012915 | A1 | 1/2008 | Ishizawa et al. | |
| 2008/0036806 | A1 * | 2/2008 | Shinada et al. | 347/9 |
| 2008/0094429 | A1 | 4/2008 | Miyazawa et al. | |
| 2009/0015644 | A1 * | 1/2009 | Shinada et al. | 347/92 |

FOREIGN PATENT DOCUMENTS

| | | | |
|---|---|---|---|
| EP | 1258359 | A1 | 11/2002 |
| EP | 1314565 | A3 | 11/2003 |
| EP | 1661710 | A2 | 5/2006 |
| EP | 1661710 | A3 | 11/2006 |
| EP | 1757453 | A1 | 2/2007 |
| EP | 1792734 | A2 | 6/2007 |
| GB | 2424211 | A | 9/2006 |
| JP | 2001-146019 | A | 5/2001 |
| JP | 2001-146030 | A | 5/2001 |
| JP | 2004-167692 | A | 6/2004 |
| JP | 2004-203059 | A | 7/2004 |
| WO | 2007/122793 | A1 | 11/2007 |
| WO | 2007/122794 | A1 | 11/2007 |

* cited by examiner

LIQUID INJECTING METHOD AND LIQUID CONTAINER

BACKGROUND

1. Technical Field

The present invention relates to a method of injecting a liquid into a liquid container of an open-air type that supplies a liquid contained in a container body detachably attached to a liquid consuming device and a liquid container manufactured using the method.

2. Related Art

Examples of the liquid container and the liquid consuming device include an ink cartridge of an open-air type containing an ink liquid and an ink jet printer to which the ink cartridge is detachably attached.

In the ink cartridge, a container body detachably attached to a cartridge-attached portion of the ink jet printer generally includes an ink containing chamber for containing ink I, an ink supply port for supplying the ink contained in the ink containing chamber to the ink jet printer, an ink guide path for allowing the ink containing chamber to communicate with the ink supply port, and an air communicating path for introducing open air into the ink containing chamber from the outside with a consumption of the ink I contained in the ink containing chamber. When the ink cartridge is attached to the cartridge-attached portion of the ink jet printer, an ink supply needle equipped in the cartridge-attached portion is inserted into the ink supply port, and the stored ink I is then supplied to the printing head of the ink jet printer.

The printing head of the ink jet printer controls an ejecting process of an ink drop using heat or vibration. However, if the printing head operates in order to eject the ink I in a state where the ink is exhausted in the ink cartridge and the ink is not supplied, idle printing occurs. Accordingly, the printing head is damaged. In order to prevent the idle printing from occurring in the ink jet printer, it is necessary to monitor an amount of the residual ink liquid in the ink cartridge.

Accordingly, in order to prevent the idle printing from occurring when the ink stored in the ink cartridge is completely exhausted, there is suggested an ink cartridge that is equipped with a liquid residual quantity sensor for outputting a predetermined electrical signal to the ink jet printer when the residual quantity of the ink I contained in the container body is consumed up to a threshold in advance (for example, Patent Document 1).

Patent Document 1: JP-A-2001-146030

An ink cartridge is a high precision container constituted by multiple elements and thus the container is more expensive than the ink which is the content thereof. For this reason, when the ink is exhausted, the disposal of the ink cartridge results in a waste of a useful resource and a big economical loss.

Accordingly, it is required that the used ink cartridge be re-used by injecting ink thereinto.

However, when the known ink cartridge is manufactured, an ink injecting step of the ink I is included. Accordingly, after the ink cartridge is manufactured, there are many cases where the same ink injecting step cannot be used.

As a result, it is necessary to develop a method of injecting ink in order to embody a re-filling of the ink I, instead of the ink injecting method when a new ink cartridge is manufactured.

A recent ink cartridge becomes high efficient in that a differential pressure valve that is provided to an ink guide path for allowing the ink containing chamber to communicate with an ink supple hole to adjust an ink pressure that allows the ink to be supplied to the ink supply port and that also serves as a non-return valve for preventing the ink from flowing backward from an ink supply port is provided, or a liquid residual quantity sensor that is used for detecting an amount of the residual ink I are equipped in the ink cartridge. Moreover, a configuration of the ink containing chamber or an air communicating path becomes complicated to maintain a good quality of the stored ink I for a long time.

For this reason, if a container body is arranged carelessly at the time of injecting the ink I, the ink I may leak into portions other than the ink containing chamber or an original function may be damaged due to bubbles B mixed at the time of injecting the ink. Therefore, a poor recovery may be caused.

In addition, since the steps of injecting ink into the container body are complicated and it is expensive to perform the process, the recovery cost may be more expensive than a manufacturing cost of a new ink cartridge. Then, there is no sense in recovering the ink cartridge.

SUMMARY

An advantage of some aspects of the invention is to provide enable the used liquid container to be used at an inexpensive cost in that the steps of injecting a liquid into the container body are simple, and moreover the liquid is injected without damaging the original function of the liquid container. The advantage can be attained by at least one of the following aspects:

(1) A first aspect of the invention provides a method of injecting a liquid into a liquid container detachably mounted on a liquid consuming device, the liquid container comprising: a liquid containing chamber containing the liquid; a liquid supply port connectable to the liquid consuming device; a liquid guide path for guiding the liquid contained in the liquid containing chamber to the liquid supply port; an air communicating path communicating the liquid containing chamber with air and having a communicating passage portion that is narrower than at least a part of other communicating paths in the air communicating path and can store some liquid contained in the liquid containing chamber by a meniscus; and a liquid residual quantity sensor provided in the liquid guide path and for outputting different signals between in a case where the liquid guide path is filled with the liquid and in a case where the liquid guide path includes air entered thereinto, wherein the liquid contained in the liquid containing chamber can be blocked from the air by the liquid stored in the communicating passage portion, the method comprising: forming an injection port on a more upstream side than an upstream end of the communicating passage portion; injecting a predetermined amount of liquid from the injection port; and sealing the injection port after injecting the liquid.

According to the above-described configuration, the steps performed to inject the liquid into the container body include the steps of opening the injection port used for injecting the liquid and sealing the injection port after re-filling the liquid, which are all performed in a simple way. Accordingly, the used liquid container is enabled to be used at an inexpensive cost in that the steps of injecting a liquid into the container body of the used liquid container are performed in the simple way. Moreover, the liquid can be injected without damaging the original function of the liquid container and the liquid container can be used at a low price.

The injecting method may preferably further comprise depressurizing an inside of the liquid containing chamber.

According to the method of injecting the liquid, since the inside of the liquid containing chamber is depressurized in the depressurization process, the liquid can be effectively injected into the ink containing chamber.

In the method of injecting the liquid, the inside of the liquid containing chamber may depressurized through the liquid supply port.

According to the method of injecting the liquid, specifically, when the liquid container is provided with a differential valve, the liquid can be injected up to a downstream of the differential valve.

(2) A second aspect of the invention provides a liquid container detachably mounted on a liquid consuming device, the liquid container comprising: a liquid containing chamber containing a liquid; a liquid supply port connectable to the liquid consuming device; a liquid guide path for guiding the liquid contained in the liquid containing chamber to the liquid supply port; an air communicating path communicating the liquid containing chamber with air and having a communicating passage portion that is narrower than at least a part of other communicating paths in the air communicating path and can store some liquid contained in the liquid containing chamber by a meniscus; and a liquid residual quantity sensor provided in the liquid guide path and for outputting different signals between in a case where the liquid guide path is filled with the liquid and in a case where the liquid guide path includes air entered thereinto, wherein the liquid contained in the liquid containing chamber can be blocked from the air by the liquid stored in the communicating passage portion, and wherein an injection port is formed on a more upstream side than an upstream end of the narrow communicating passage portion, a predetermined amount of liquid is injected from the injection port, and the injection port is sealed after injecting the liquid.

According to the liquid container having the above-described configuration, since the liquid container re-fills with the liquid like a new manufactured liquid container, the liquid container normally functions as good as a new manufactured unused liquid container, and thus can be used as easily as the new manufactured unused liquid container. Moreover, since the expected life span of the liquid container becomes longer, the resources can be saved and the environmental pollution can be thus prevented.

Further, since a cost required for the re-filling is inexpensive and the ink cartridge is provided at a low price, a running cost for the ink jet printer can be reduced.

In the liquid container having the above-described configuration, an air outflow port at one end of the communicating passage portion may be provided adjacent to a bottom wall of the liquid containing chamber and an air inflow port at the other end thereof is provided lower than the bottom wall of the liquid containing chamber.

According to the liquid container having the above-described configuration, when a predetermined amount of the liquid is, for example, re-filled into the liquid containing chamber at the time of injecting the liquid or the like, a liquid pressure of the liquid containing chamber applied to the air outflow port enables a necessary amount of a liquid to be sent to the narrow communicating passage portion so as to keep the liquid. As a result, it is easy to form a liquid sealing portion in the air communicating path.

In the liquid container having the above-described configuration, the communicating passage portion may be formed in a substantial L shape.

According to the liquid container having the above-described configuration, the movement of the liquid kept in the narrow communicating passage portion is controlled by a meniscus force generated in an L-shaped bent. As a result, the liquid in the narrow communicating passage portion can be stably kept so as to be sealed.

In the liquid container having the above-described configuration, the liquid container may preferably further comprise a differential pressure valve which is disposed in the liquid flow passage, which is normally urged to be a closed state, and which is changed from the closed state to an opened state when a differential pressure between a side of the liquid supply portion and a side of the liquid containing portion is equal to or more than a predetermined value.

(3) A third aspect of the invention provides a liquid container detachably mounted on a liquid consuming device, the liquid container comprising: a liquid containing chamber containing a liquid; a liquid supply port for supplying the liquid to an outside; a liquid guide path communicating the liquid containing chamber and the liquid supply port with each other; an air communicating path communicating the liquid containing chamber with air and having a communicating passage portion that is directly connected to the liquid containing chamber and can store some liquid contained in the liquid containing chamber by a meniscus; a liquid residual quantity sensor provided in the liquid guide path and for outputting different signals between in a case where the liquid guide path is filled with the liquid and in a case where the liquid guide path includes air entered thereinto; a film member forming at least a part of the air communication path; and a sealing portion at which an injection port formed on the film and positioned on a more upstream side than an upstream end of the communicating passage portion is sealed, wherein the liquid contained in the liquid containing chamber can be blocked from the air by the liquid stored in the communicating passage portion.

According to the liquid container having the above-described configuration, since the liquid container re-fills with the liquid like a new manufactured liquid container, the liquid container normally functions as good as a new manufactured unused liquid container, and thus can be used as easily as the new manufactured unused liquid container. Moreover, since the expected life span of the liquid container becomes longer, the resources can be saved and the environmental pollution can be thus prevented.

Further, since a cost required for the re-filling is inexpensive and the ink cartridge is provided at a low price, a running cost for the ink jet printer can be reduced.

In the liquid container having the above-described configuration, the sealing portion may be preferably formed by a film or an adhesive material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid injecting method and a liquid container according to an exemplary embodiment of the invention will be described in detail with reference to drawings. In the exemplary embodiment described below, as an exemplified liquid container, an ink cartridge mounted on an ink jet printing apparatus (printer), which is an example of a liquid ejecting apparatus, will be described.

Figure 1:
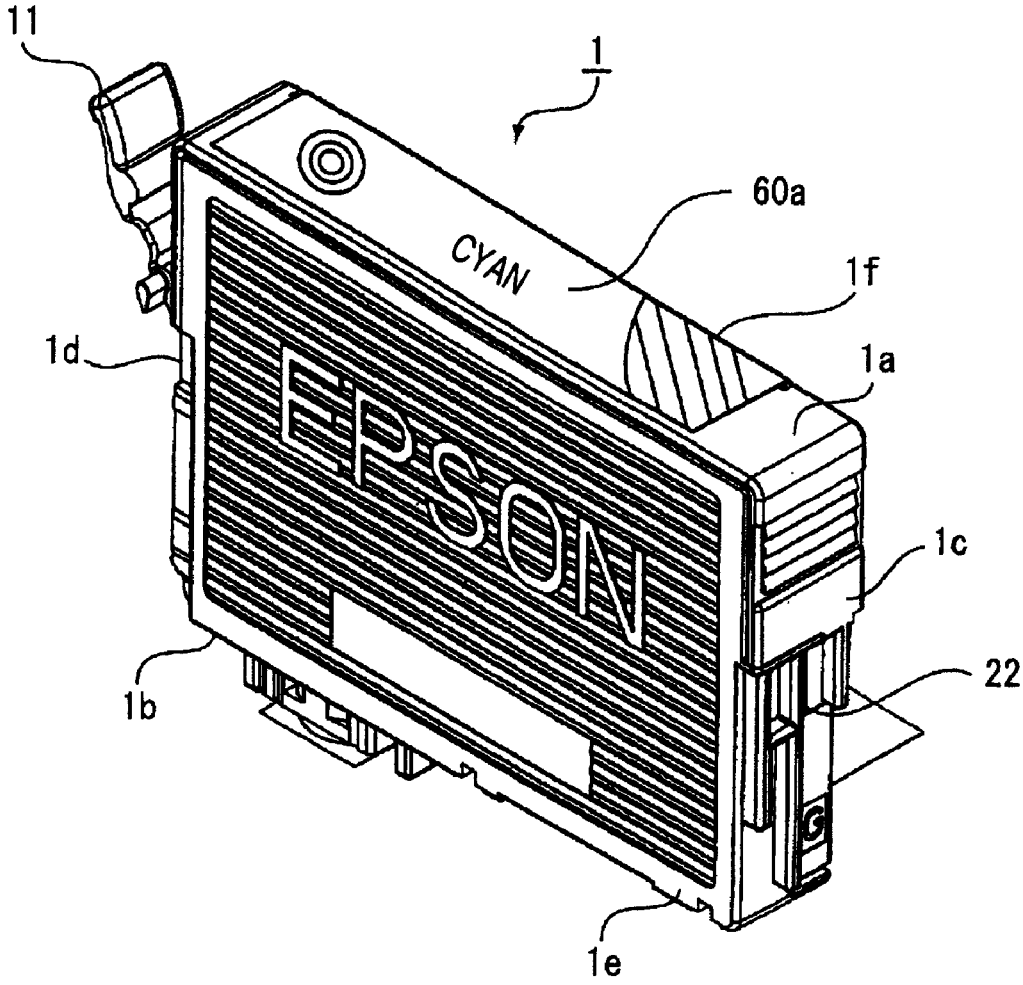
FIG. 1 is an exterior perspective view illustrating an ink cartridge which is a liquid container according to an exemplary embodiment of the invention.

FIG. 1 is an exterior perspective view illustrating the ink cartridge which is an example of the liquid container according to an exemplary embodiment of the invention.

Figure 2:
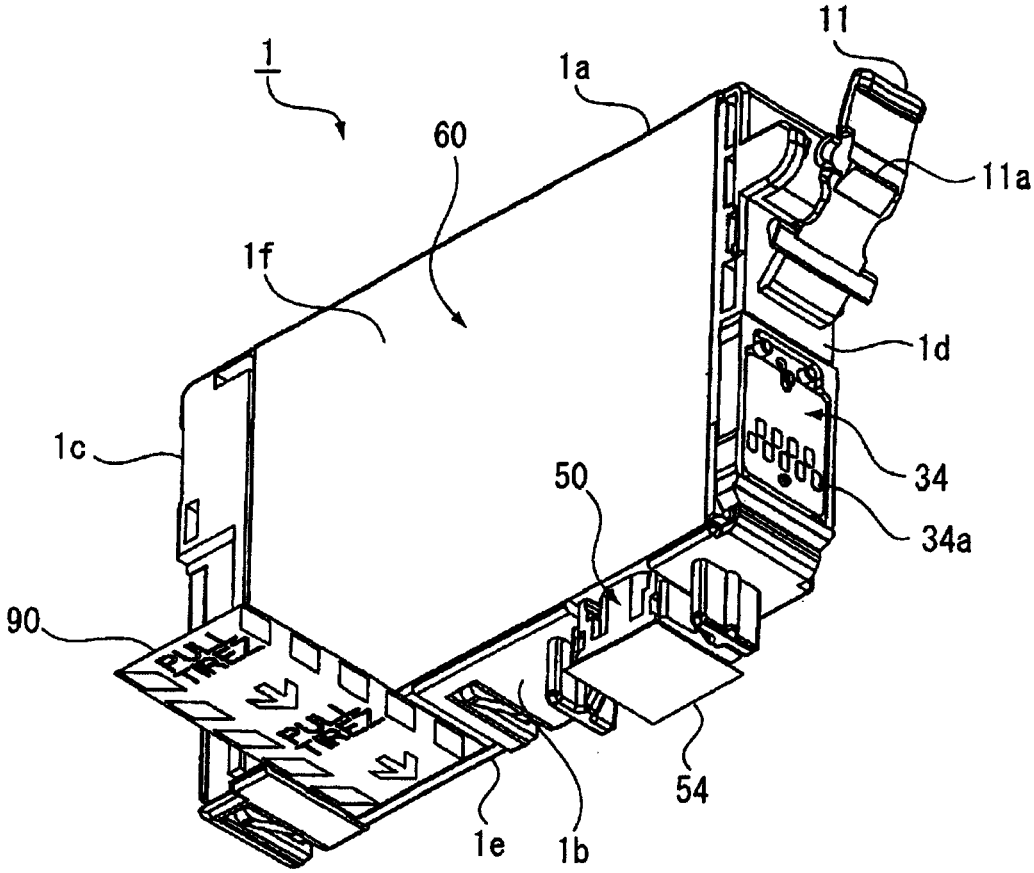
FIG. 2 is an exterior perspective view illustrating the ink cartridge shown in FIG. 1 when viewed at an inverse angle in FIG. 1.
Figure 3:
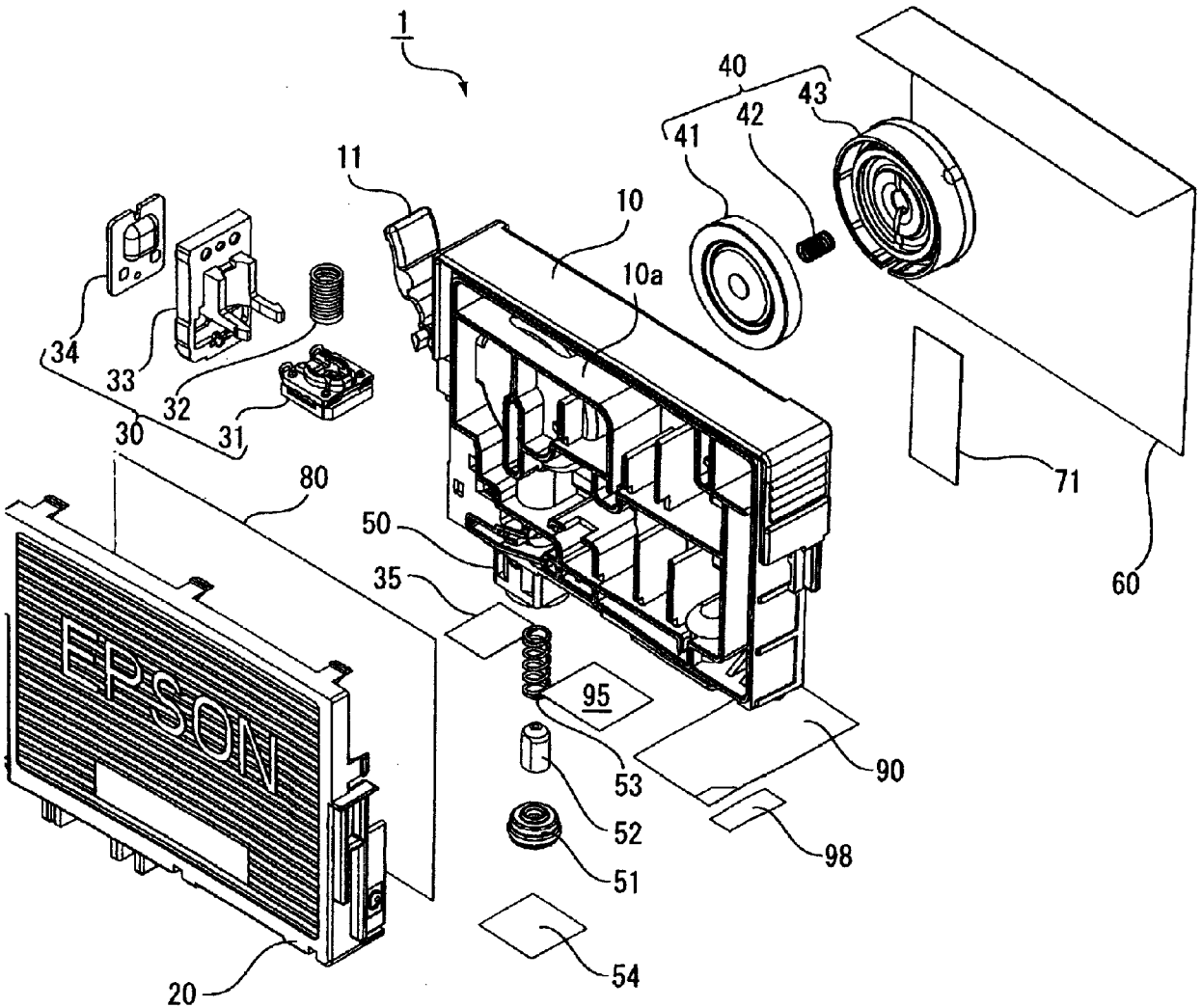
FIG. 3 is an exploded perspective view illustrating the ink cartridge shown in FIG. 1.
Figure 4:
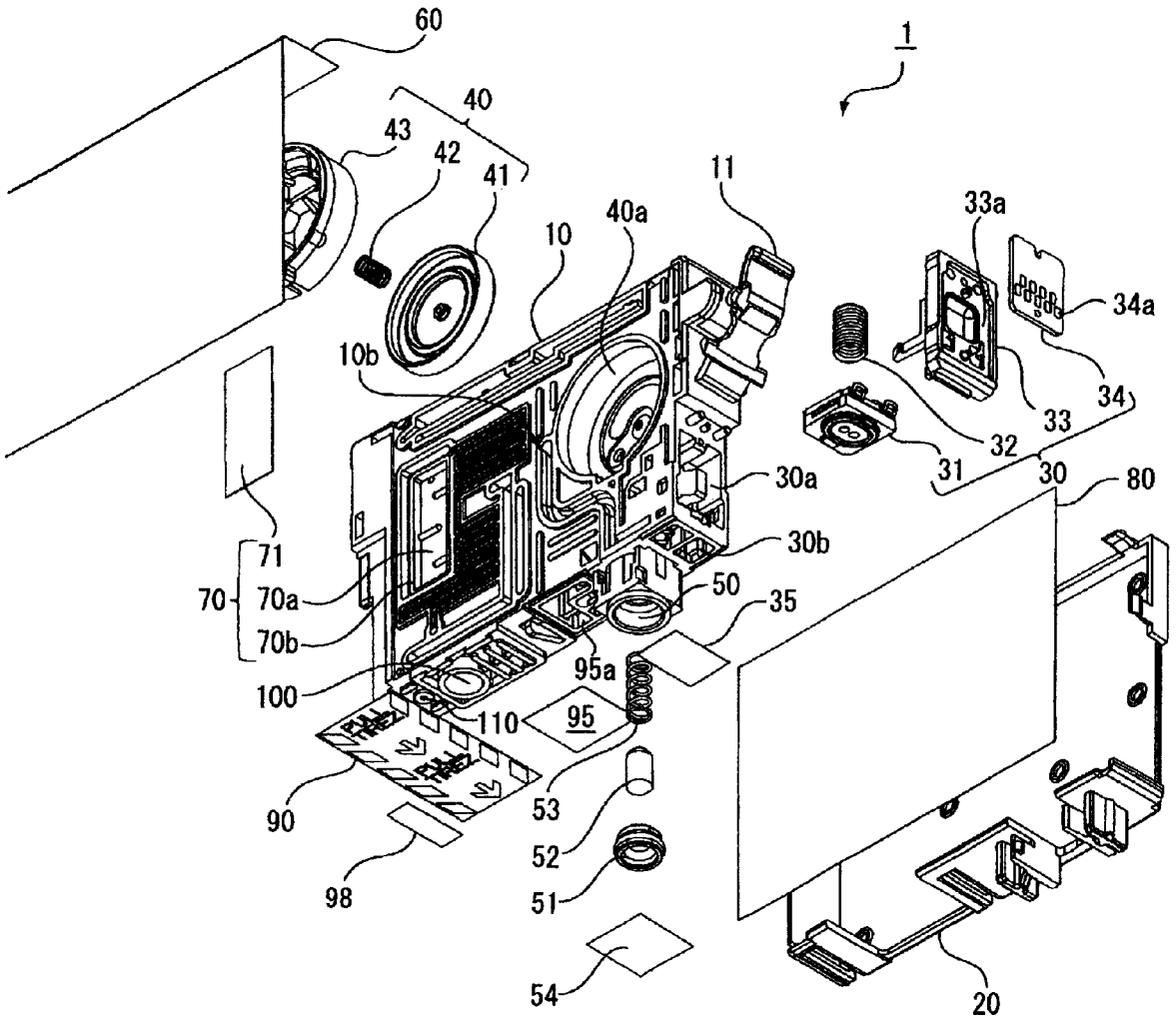
FIG. 4 is an exploded perspective view illustrating the ink cartridge shown in FIG. 3 when viewed at an inverse angle in FIG. 3.
Figure 5:
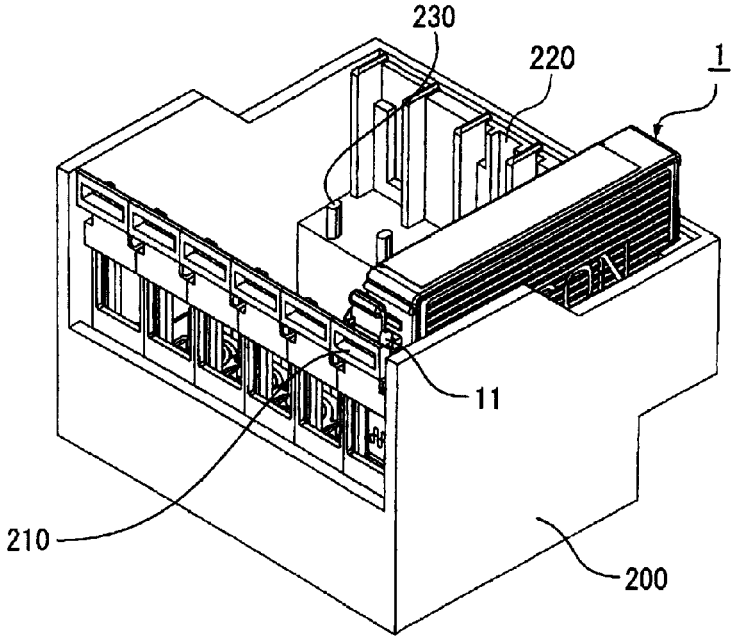
FIG. 5 is a view illustrating when the ink cartridge shown in FIG. 1 is mounted on a carriage of an ink jet printer.
Figure 6:
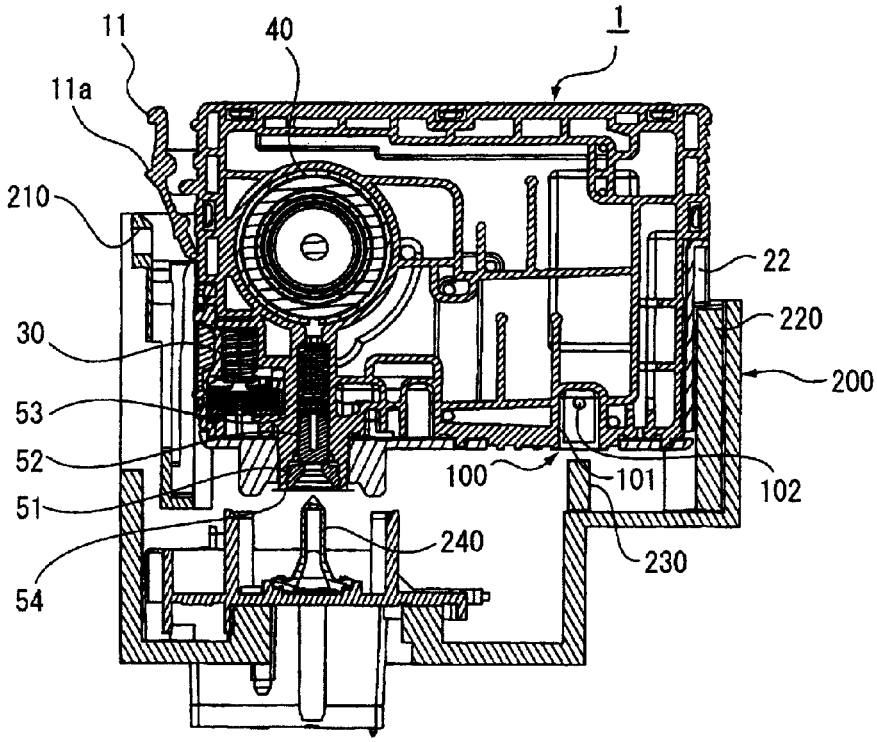
FIG. 6 is a sectional view illustrating the ink cartridge shown in FIG. 1 immediately before the ink cartridge is mounted on the carriage.
Figure 7:
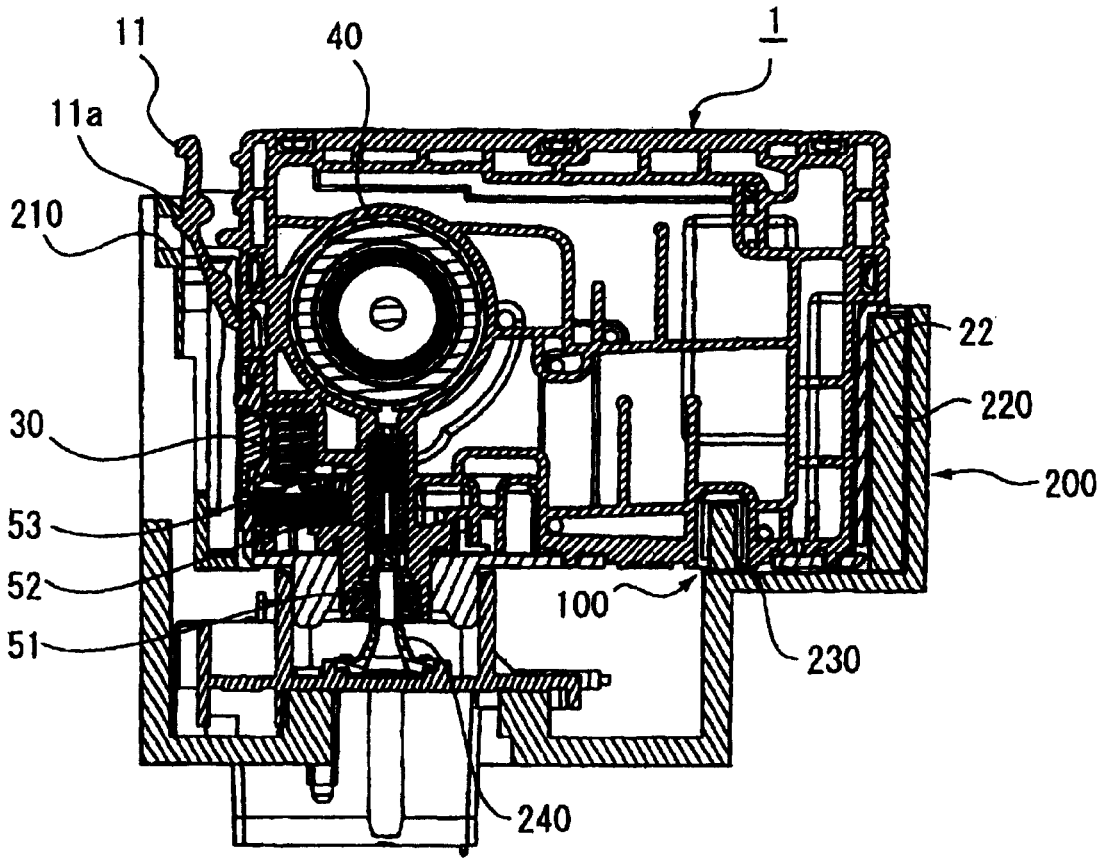
FIG. 7 is a sectional view illustrating the ink cartridge shown in FIG. 1 immediately after the ink cartridge is mounted on the carriage.

FIG. 2 is an exterior perspective view illustrating the ink cartridge according to the exemplary embodiment when viewed at an inverse angle in FIG. 1. FIG. 3 is an exploded perspective view illustrating the ink cartridge according to the exemplary embodiment. FIG. 4 is an exploded perspective view illustrating the ink cartridge according to the exemplary embodiment when viewed at an inverse angle in FIG. 3. FIG. 5 is a view illustrating when the ink cartridge according to the exemplary embodiment is mounted on a carriage. FIG. 6 is a sectional view illustrating the ink cartridge immediately before the ink cartridge is mounted on the carriage. FIG. 7 is a sectional view illustrating the ink cartridge immediately after the ink cartridge is mounted on the carriage.

As shown in FIGS. 1 and 2, an ink cartridge 1 according to the exemplary embodiment has a substantially rectangular parallelepiped shape and is the liquid container for storing/containing ink (liquid) I in an ink containing chamber (liquid containing portion) that is provided therein. The ink cartridge 1 is mounted on a carriage 200 of an ink jet printing apparatus that is an example of a liquid consuming device so as to supply the ink to the ink jet printing apparatus (see FIG. 5).

An outer appearance of the ink cartridge 1 will be described. As shown in FIGS. 1 and 2, the ink cartridge 1 has a flat upper surface 1*a*, and an ink supply port (liquid supply hole) 50 that is connected to the ink jet printing apparatus to supply the ink is provide on a bottom surface 1*b* that is opposite to the upper surface 1*a*. Further, an air introducing hole 100 that communicates with the inside of the ink cartridge 1 for introducing air into the ink cartridge 1 opens in the bottom surface 1*b*.

That is, the ink cartridge 1 serves as an ink cartridge of an open-air type that provides ink from the ink supply port 50 while introducing the air from the air introducing hole 100.

In the exemplary embodiment, the air introducing hole 100 of the ink cartridge 1, as shown in FIG. 6, has a substantially cylindrical concave portion 101 that opens from the bottom surface toward the upper surface in the bottom surface 1*b* and a small hole 102 that opens in the inner circumference surface of the concave portion 101. Since the small hole 102 communicates with an air communicating path described below, the air is introduced into an ink containing chamber 370 (described below) positioned on an uppermost stream through the small hole 102.

The concave portion 101 of the air introducing hole 100 is formed in a position in which a protrusion 230 formed in the carriage 200 can be inserted. The protrusion 230 serves as a non-removing prevention protrusion for preventing a user from forgetting removal of a sealing film 90 that is means for air-tightly blocking the air introducing hole 100. That is, when the sealing film 90 is attached to the air introducing hole 100, the protrusion 230 cannot be inserted into the air introducing hole 100, and thus the ink cartridge 1 is not mounted on the carriage 200. Accordingly, even when a user tries to mount the ink cartridge 1 on the carriage 200 with the sealing film 90 attached to the air introducing hole 100, the ink cartridge 1 cannot be mounted. As a result, when the ink cartridge 1 is mounted, it is demanded that the sealing film 90 is reliably removed.

As shown in FIG. 1, an erroneous inserting prevention protrusion 22 for preventing the ink cartridge 1 from being mounted on an erroneous position is formed on a narrow side surface 1*c* adjacent to one end side of the upper surface 1*a* of the ink cartridge 1. As shown in FIG. 5, an uneven portion 220 corresponding to the erroneous inserting prevention protrusion 22 is formed on the carriage 200 which serves as a receiver. The ink cartridge 1 is mounted on the carriage 200 only when the erroneous inserting prevention protrusion 22 and the uneven portion 220 are not interfered with each other. The erroneous inserting prevention protrusion 22 has a different shape according to each kind of ink, and thus the uneven portion 220 on the carriage 200 which serves as the receiver has also a different shape according to the corresponding kind of ink. As a result, even when the plurality of ink cartridges is mounted on the carriage 200, as shown in FIG. 5, the ink cartridges may not be mounted on erroneous positions.

As shown in FIG. 2, an engagement lever 11 is provided on a narrow side surface 1*d* that is opposite to the narrow side surface 1*c* of the ink cartridge 1. A protrusion 11*a* that is engaged with a concave portion 210 formed in the carriage 200 when the ink cartridge 1 is mounted to the carriage 200 is formed in the engagement lever 11. Moreover, the protrusion 11*a* and the concave portion 210 are engaged with each other while the engagement lever 11 is bent so that the ink cartridge 1 is fixed on the carriage 200.

A circuit board 34 is provided below the engagement lever 11. A plurality of electrode terminals 34*a* are formed on the circuit board 34. Since the electrode terminals 34*a* comes in contact with an electrode member (not shown) provided in the carriage 200, the ink cartridge 1 is electrically connected with the ink jet printing apparatus. A nonvolatile memory capable of rewriting data is provided in the circuit board 34. Various data about the ink cartridge 1, ink use data of the ink jet printing apparatus, or the like are memorized in the nonvolatile memory. An ink residual quantity sensor 31 (liquid residual quantity sensor) used for detecting an amount of residual ink in the ink cartridge 1 using residual vibration is provided in the back of the circuit board 34 (see FIG. 3 or 4). Hereinafter, the ink residual quantity sensor 31 and the circuit board 34 are called an ink end sensor 30.

As shown in FIG. 1, a label 60*a* for denoting a content of an ink cartridge is attached to the upper surface 1*a* of the ink cartridge 1. The edge of an outer surface film 60 that covers a wide side surface 1*f* is extended and attached to the upper surface 1*a* so that the label 60*a* is formed.

As shown in FIGS. 1 and 2, the wide side surfaces 1*e* and 1*f* adjacent two long sides of the upper surface 1*a* of the ink cartridge 1 are formed in a flat surface shape. Hereinafter, a side of the wide side surface 1*e*, a side of the wide side surface 1*f*, a side of the narrow side surface 1*c*, and a side of the narrow side surface 1*d* denote a front side surface, a rear side surface, a right side surface, and a left side surface, respectively for convenience' sake.

Next, each portion constituting the ink cartridge 1 will be described with reference to FIGS. 3 and 4.

The ink cartridge 1 has a cartridge body 10 that is the container body and a cover member 20 for covering the front side surface of the cartridge body 10.

Ribs 10*a* that have various shapes are formed in the front side surface of the cartridge body 10. In order to form walls, the ribs 10*a* partition a plurality of the ink containing chambers (liquid containing portion) that fill with the ink I, a non-containing chamber which does not fill with the ink I, an air chamber that is positioned in a way of the air communicating path 150 described below, and so on in the inside of the cartridge body 10.

A film 90 that covers the front side surface of the cartridge body 10 is provided between the cartridge body 10 and the cover member 20. The film 80 covers the upper surfaces of the ribs, concave portions, grooves so that a plurality of flow passages, the ink containing chambers, the non-containing chamber, the air chamber are formed.

In the rear side surface of the cartridge body 10, a concave-shaped differential pressure valve accommodating chamber 40*a* accommodating a differential pressure valve 40 and a concave-shaped gas-liquid separating chamber 70*a* constituting a gas-liquid separating filter 70 are formed.

A valve member 41, a spring 42, and a spring seat 43 are accommodated in the differential pressure valve accommodating chamber 40*a* and constitute the differential pressure valve 40. The differential pressure valve 40 is disposed between the ink supply port 50 positioned on the downstream and the ink containing chamber positioned on the upstream, and is urged to a closed state in which the ink flow from a side of the ink containing chamber to a side of the ink supply port 50 is blocked. The differential pressure valve 40 is configured so that when a differential pressure between the side of the ink containing chamber and the side of the ink supply port 50 becomes a predetermined value or more depending on ink supply from the ink supply port 50 to the printer, the differential valve 40 is changed from the closed state to the opened state and the ink I is supplied to the ink supply port 50.

On the upper surface of the gas-liquid separating chamber 70*a*, a gas-liquid separating film 71 is attached along a dam 70*b* surrounding an outer circumference provided in the vicinity of the middle portion of the gas-liquid separating chamber 70*a*. The gas-liquid separating film 71 is made of a material that passes a gas, but does not pass a liquid. The gas-liquid separating film 71 constitutes the gas-liquid separating filter 70. The gas-liquid separating filter 70 is provided within the air communicating path 150 that connects the air introducing hole 100 to the ink containing chamber, and allows the ink I in the ink containing chamber not to leak to the air introducing hole 100 through the air communicating path 150.

In the rear side surface of the cartridge body 10, a plurality of grooves 10*b* are carved in addition to the differential pressure accommodating chamber 40*a* and the gas-liquid separating chamber 70*a*. Since the outer surface film 60 covers the outer surface in a state where the differential pressure valve 40 and the gas-liquid separating filter 70 are formed, the opening of each groove b is blocked, and thus the air communicating path 150 or an ink guide path (liquid guide path) is formed.

As shown in FIG. 4, a concave-shaped sensor chamber 30*a* that accommodates each member constituting the ink end sensor 30 is formed in the right side surface of the cartridge body 10. The ink residual quantity sensor 31 and a compressing spring 32 for pressing the ink residual quantity sensor 31 against the inner wall of the sensor chamber 30*a* are accommodated in the sensor chamber 30*a*. The opening of the sensor chamber 30*a* is covered with a cover member 33 so that the circuit board 34 is fixed on an outer surface 33*a* of the cover member 33. A sensing member of the ink residual quantity sensor 31 is connected to the circuit board 34.

The ink residual quantity sensor 31 includes a cavity forming a part of the ink guide path between the ink containing chamber and the ink supply port 50, a vibrating plate forming a part of the wall surface of the cavity, and a piezoelectric element (piezoelectric actuator) allowing vibration to be applied onto the vibrating plate. The ink residual quantity sensor 31 outputs, to the printer as signals, residual vibration at the time of applying the vibration onto the vibrating plate. Then the printer detects whether the ink I exists in the ink guide path from the signals output from the ink residual quantity sensor 31. The printer detects a difference in an amplitude, a frequency, or the like of the residual vibration between the ink I and the gas (bubble B mixed in the ink) based on the signals output from the ink residual quantity sensor 31 so as to detect whether the ink I exists in the cartridge body 10.

Specifically, when the ink I of the ink containing chamber in the cartridge body 10 is exhausted or is lowered to a predetermined amount, air introduced into the ink containing chamber passes through the ink guide path and enter into the cavity of the ink residual quantity sensor 31. At this time, the printer detects the change in the amplitude or the frequency of the residual vibration based on the signals output from the ink residual quantity sensor 31 and outputs an electrical signal for denoting the ink end or ink near end.

As shown in FIG. 4, a depressurization hole 110 used to depressurize the ink cartridge 1 by sucking air from the inside thereof by vacuuming means when the ink is injected, a concave portion 95*a* constituting the ink guide path from the ink containing chamber to the ink supply port 50, and a buffer chamber 30*b* provided below the ink end sensor 30 are provided on the bottom surface of the cartridge body 10 in addition to the ink supply port 50 and the air introducing hole 100 described above.

Immediately after the ink cartridge is manufactured, openings of the ink supply port 50, the air introducing hole 100, the depressurization hole 110, the concave portion 95*a*, and the buffer chamber 30*b* are sealed by sealing films 54, 90, 98, 95, 35, respectively. The sealing film 90 for sealing the air introducing hole 100 is removed by a user before the ink cartridge is mounted on the ink jet printing apparatus to be used. Accordingly, the air introducing hole 100 is exposed to the outside so that the ink containing chamber in the ink cartridge 1 is allowed to communicate with open air by the air communicating path 150.

The sealing film 54 attached onto the outer surface of the ink supply port 50, as shown in FIGS. 6 and 7, is configured so as to be torn by an ink supply needle 240 of the ink jet printing apparatus when mounted on the ink jet printing apparatus.

As shown in FIGS. 6 and 7, a ring-shaped sealing member 51 that is pressed against the outer surface of the ink supply needle 240 when mounted on a printer, a spring seat 52 that comes in contact with the sealing member 51 to block the ink supply port 50 when not mounted on the printer, and a compressing spring 53 that urges the spring seat 52 in a direction of coming in contact with the sealing member 51 are included within the ink supply port 50.

As shown in FIGS. 6 and 7, the ink supply needle 240 is inserted into the ink supply port 50. At this time, the inner circumference of the sealing ember 51 and the outer circumference of the ink supply needle 240 are sealed with each other, a gap between the ink supply port 50 and the ink supply needle 240 is sealed liquid-tightly. In addition, the front end of the ink supply needle 51 comes in contact with the spring seat 52 and pushes up the spring seat 52. At this time, since the spring seat 52 and the sealing member 51 are released from each other, the ink can be supplied from the ink supply port 50 to the ink supply needle 240.

Next, the inner configuration of the ink cartridge 1 according to the exemplary embodiment will be described with reference to the FIGS. 8 to 12.

Figure 8:
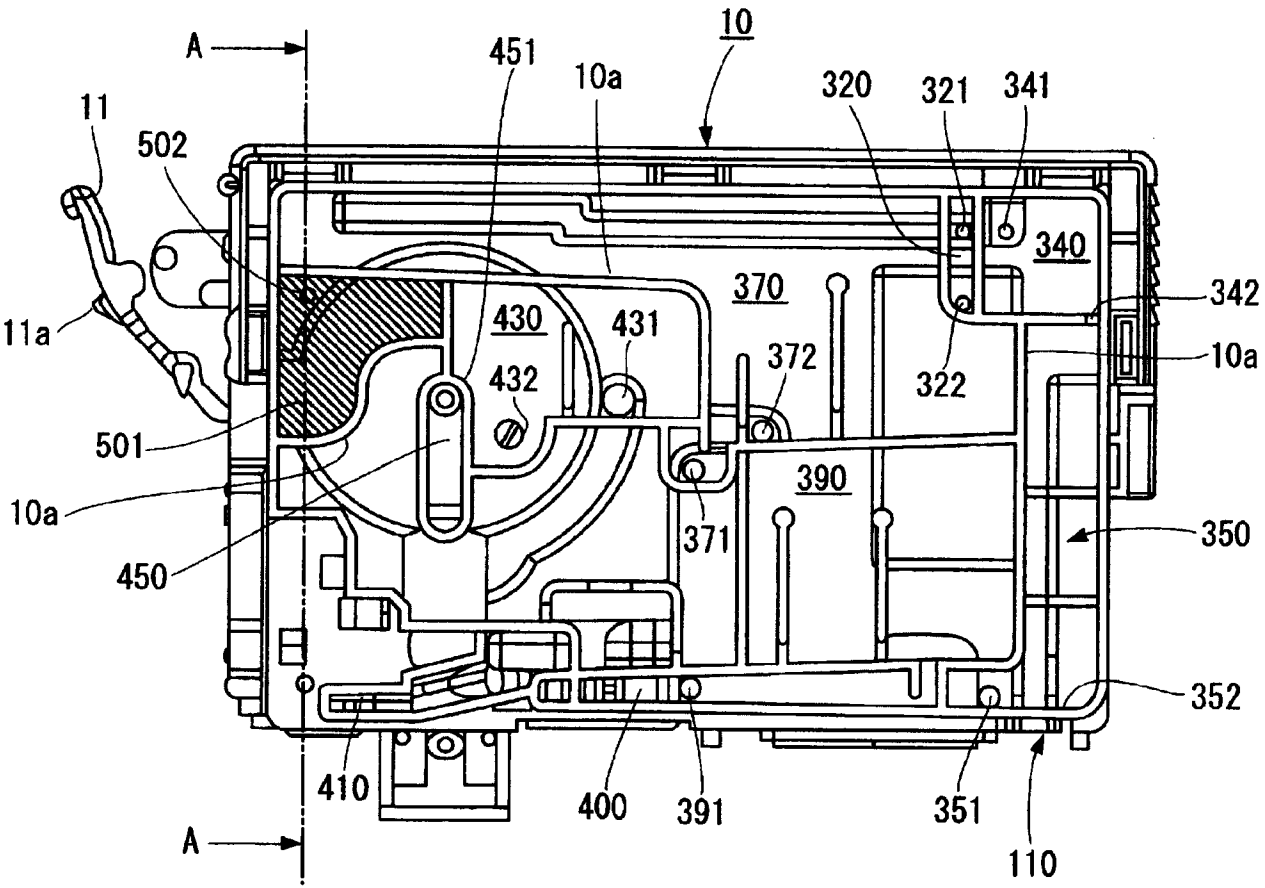
FIG. 8 is a diagram viewed from the front side surface of the cartridge body of the ink cartridge shown in FIG. 1.
Figure 9:
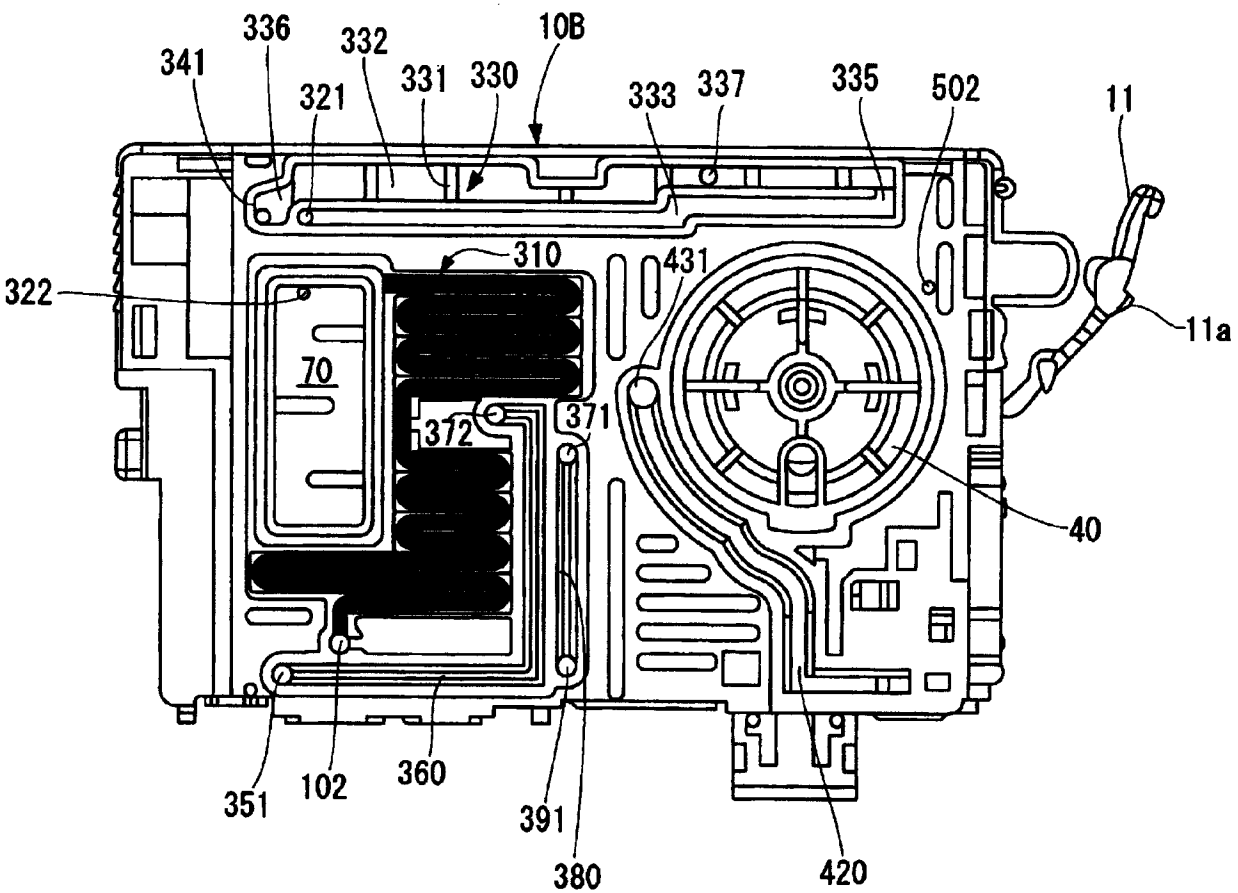
FIG. 9 is a diagram viewed from the rear side surface of the cartridge body of the ink cartridge shown in FIG. 1.
Figure 10:
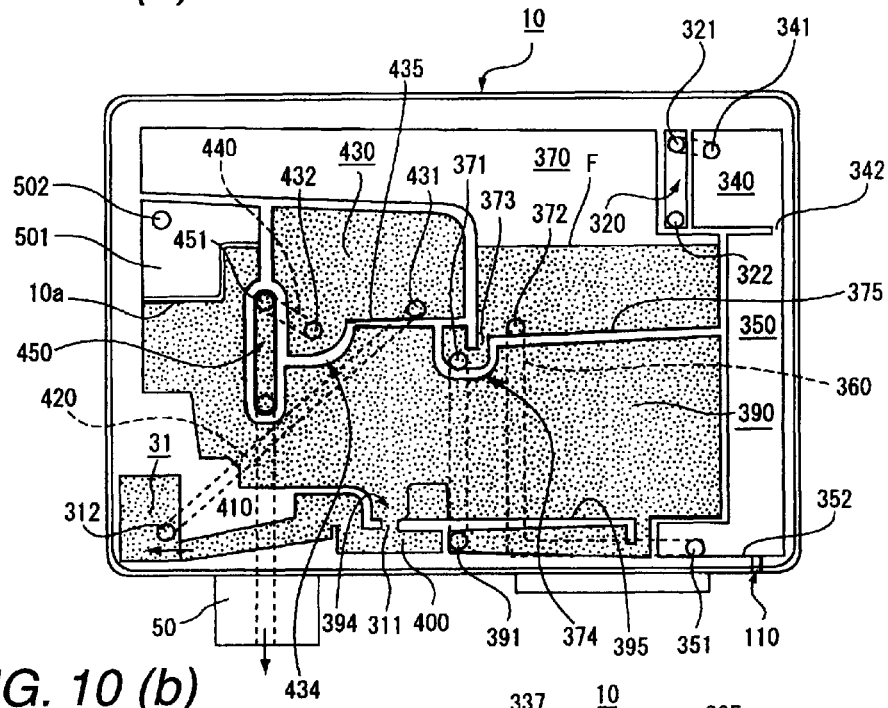
FIG. 10(*a*) is a schematic diagram of the FIG. 8 and FIG. 10(*b*) is a schematic diagram of the FIG. 9.
Figure 10:
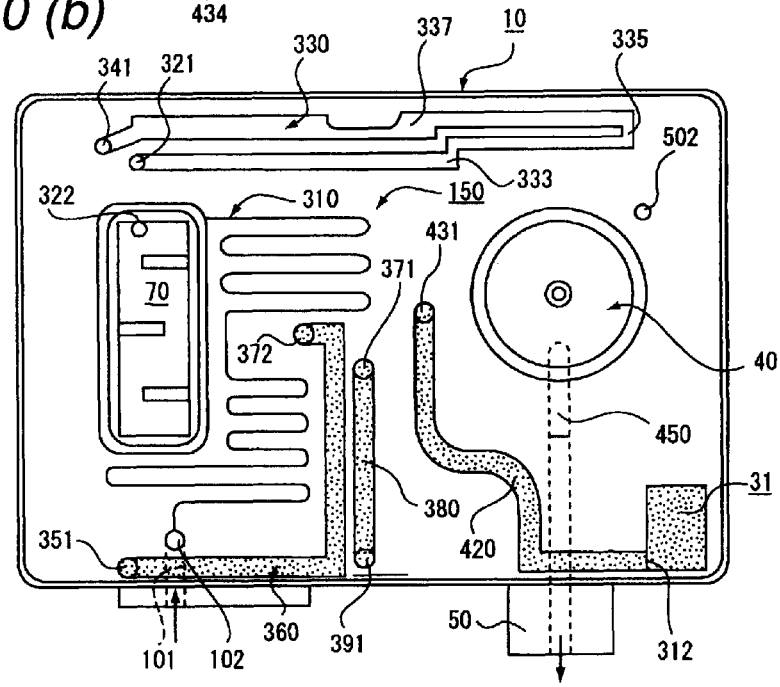
Figure 11:
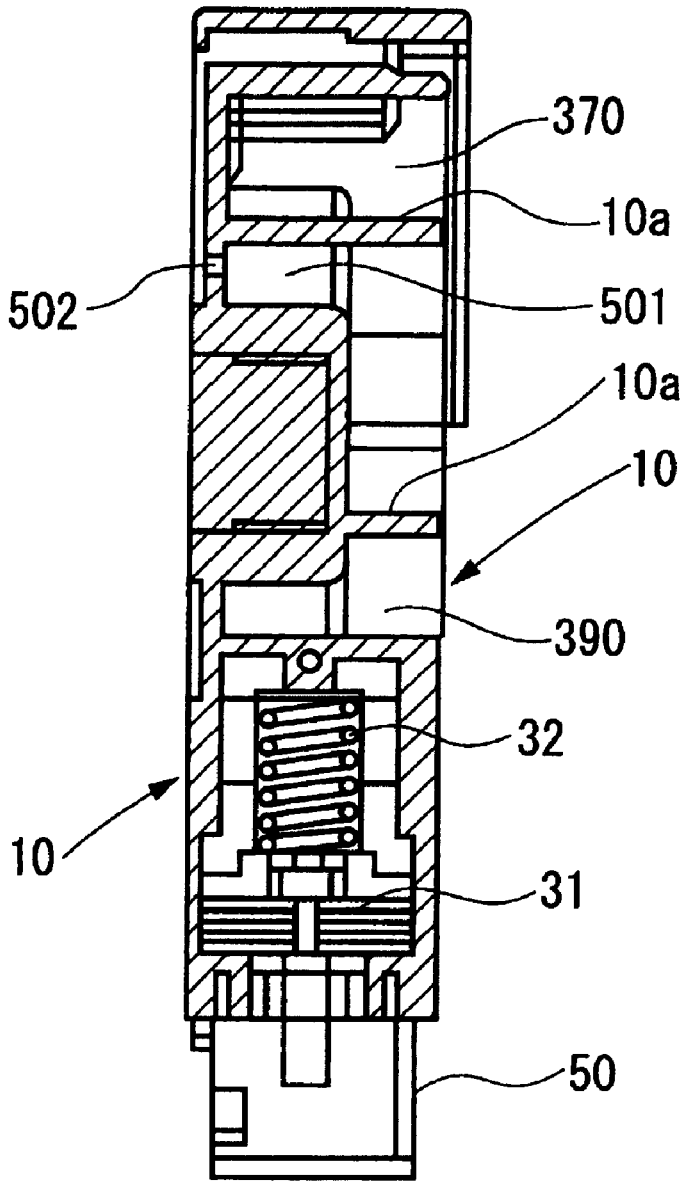
FIG. 11 is a sectional view taken along the line A-A of FIG. 8.
Figure 12:
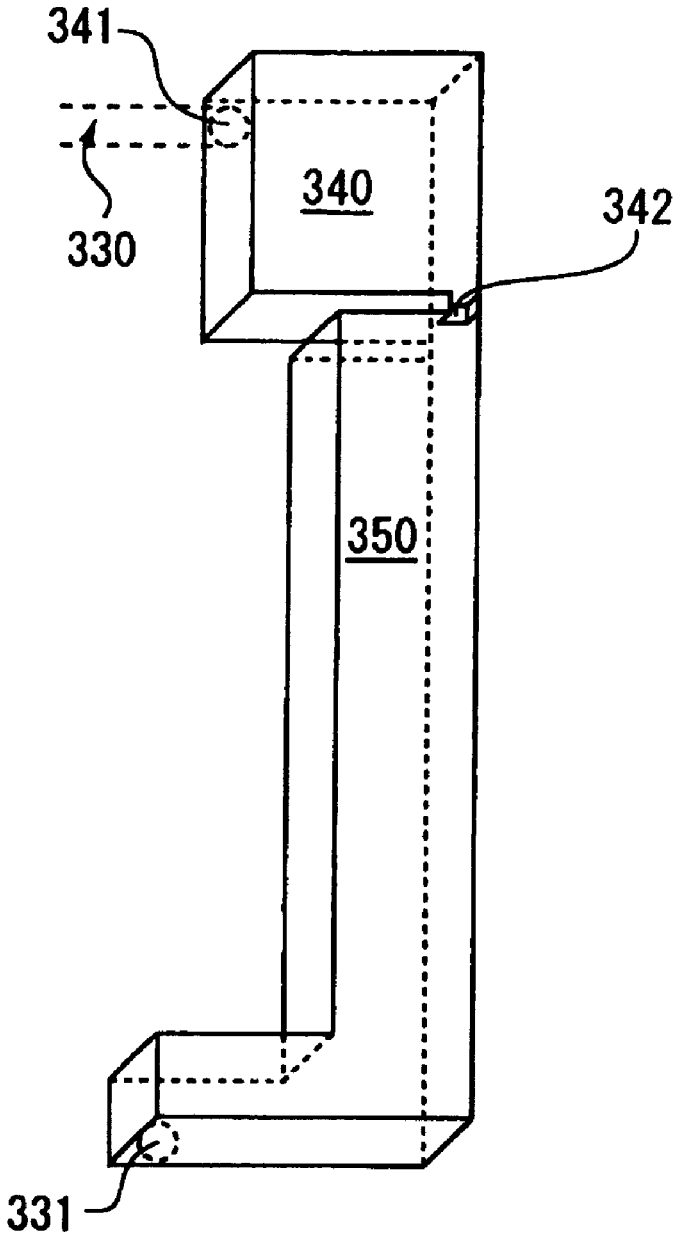
FIG. 12 is a partly enlarged perspective view illustrating a configuration of flow passages shown in FIG. 8.

FIG. 8 is a diagram viewed from the front side surface of the cartridge body 10 of the ink cartridge 1 according to the exemplary embodiment. FIG. 9 is a diagram viewed from the rear side surface of the cartridge body 10 of the ink cartridge 1 according to the exemplary embodiment. FIG. 10(*a*) is a schematic diagram of the FIG. 8 and FIG. 10(*b*) is a schematic diagram of the FIG. 9. FIG. 11 is a sectional view taken along the line A-A of FIG. 8. FIG. 12 is a partly enlarged perspective view illustrating a flow passage shown in FIG. 8.

In the ink cartridge 1 according to the exemplary embodiment, three ink containing chambers, that is, the upper ink containing chamber 370 and a lower ink containing chamber 390 as primary ink containing chambers for filling with the ink I, and the buffer chamber 430 which is positioned so as to be interposed therebetween are formed in the front side surface of the cartridge body 10.

Further, in the rear side surface of the cartridge body 10, the air communicating path 150 introducing air into the upper ink containing chamber 370, which is the ink containing chamber positioned on the uppermost stream, according to a consumption amount of the ink I, is formed.

The ink containing chambers 370 and 390 and the buffer chamber 430 are partitioned by a rib 10*a*. According to the exemplary embodiment, in each ink containing chamber, recesses 374, 394, and 434 having a caved-in shape downward are formed in a part of the rib 10*a* that horizontally extend so as to be bottom walls of the ink containing chambers.

The recess 374 is formed in the manner that a part of a bottom wall 375 formed by the rib 10*a* of the upper ink containing chamber 370 is caved in downward. The recess 394 is formed in the manner that a bottom wall 395 formed by the rib 10*a* of the lower ink containing chamber 390 and a bulge of the wall surface are caved in a thicknesswise direction of the cartridge. The recess 434 is formed in the manner that a part of a bottom wall 435 formed by the rib 10*a* of the buffer chamber 430 is caved in downward.

Moreover, ink discharging ports 371, 312, and 432 that communicate with the ink guide path 380, 420, and 440 are provided in bottom portions or the vicinity of the recesses 374, 394, and 434, respectively.

The ink discharging ports 371 and 432 are through-holes that penetrates the wall surface of each ink containing chamber in the thicknesswise direction of the cartridge body 10. In addition, the ink discharging port 312 is an outlet of a cavity (flow passage) in the ink residual quantity sensor 31.

One end portion of the ink guide path 360 communicates with the ink discharging port 371 of the upper ink containing chamber 370 while the other end portion thereof communicates with an ink inflow port 391 provided in the lower ink containing chamber 390. In this way, the ink guide path 380 serves as a communicating flow passage for guiding the ink I contained in the upper ink containing chamber 370 to the lower ink containing chamber 390. The ink guide path 380 is provided so as to extend from the ink discharging port 371 of the upper ink containing chamber 370 vertically downward. Accordingly, the ink guide path 380 allows the pair of the ink containing chambers 370 and 390 to be connected with each other so that the ink I descends from upstream side to downstream side.

One end portion of the ink guide path 420 communicates with the ink discharging port 312 of the cavity of the ink residual quantity sensor 31 positioned on the downstream of the lower ink containing chamber 390 while the other end thereof communicates with an ink inflow port 431 provided in the buffer chamber 430. Accordingly, the ink guide path 420 guides the ink I contained in the lower ink containing chamber 390 to the buffer chamber 430. The ink guide path 420 is provided so as to extend obliquely upward from the ink discharging port 312 of the cavity in the ink residual quantity sensor 31. Accordingly, the ink guide path 420 allows the pair of the ink containing chambers 390 and 430 to be connected with each other so that the ink I ascends from upstream side to downstream side.

That is, in the cartridge body 10 according to the exemplary embodiment, the three ink containing chambers 370, 390, and 430 are allowed to be alternatively connected in series to each other so that the ink I descends or ascends.

The ink guide path 440 serves as an ink flow passage that allows the ink discharging port 432 of the buffer chamber 430 to guide the ink to a differential valve 40.

In this exemplary embodiment, the ink inflow ports 391 and 431 of the ink containing chambers are provided so as to be positioned above the ink discharging port 371 and 311 provided in the ink containing chambers and in the vicinities of the bottom walls 37S, 395, and 435 of the ink containing chambers.

First, the ink guide path from the upper ink containing chamber 370, which is a primary ink containing chamber, to the ink supply port 50 will be described below with reference to FIGS. 8 to 12.

The upper ink containing chamber 370 is an ink containing chamber positioned on the uppermost stream (the uppermost portion) in the cartridge body 10. As shown in FIG. 8, the upper ink containing chamber 370 is formed on the front side surface of the cartridge body 10. The upper ink containing chamber 370 occupies about the half of an ink contained area of the ink containing chambers and is formed above the substantial half of the cartridge body 10.

The ink discharging port 371 that communicates with the ink guide path 380 opens in the recess 374 of the bottom wall of the upper ink containing chamber 370. The ink discharging 371 is positioned below the rib 10*a* that is the bottom wall of the upper ink containing chamber 370. Even when an ink level within the upper ink containing chamber 370 falls up to the bottom wall, the ink discharging port 371 is positioned lower than the ink level. Accordingly, the ink I continues to be stably discharged.

As shown in FIG. 9, the ink guide path 380 that is formed on the rear side surface of the cartridge body 10 allows the ink I to flow from the upper portion to the lower ink containing chamber 390.

The lower ink containing chamber 390 is an ink containing chamber into which the ink I stored in the upper ink containing chamber 370 is introduced. Moreover, as shown in FIG. 8, the lower ink containing chamber 390 occupies about the half of the ink contained area of the ink containing chambers formed on the front side surface of the cartridge body 10, and is formed below the substantial half of the cartridge body 10.

The ink inflow port 391 that communicates with the ink guide path 380 opens to a communicating flow passage disposed below the bottom wall 395 of the lower ink containing chamber 390 in the vicinity of the rib 10*a* that is the bottom wall of the lower ink containing chamber 390. Accordingly, the ink I flows from the upper ink containing chamber 370 through the communicating flow passage.

An ink discharging port 311 that penetrates the bottom wall 395 allows the lower ink containing chamber 390 to communicate with the upstream ink end sensor connecting flow passage 400. A three-dimensional labyrinthine flow passage is formed in the upstream ink end sensor connecting flow passage 400. Accordingly, bubble B or the like that flow to the labyrinthine flow passage before the ink ends are caught so as not to flow toward the downstream.

The upstream ink end sensor connecting flow passage 400 communicates with a downstream ink end sensor connecting flow passage 410 through a through-hole not shown in the drawings. Moreover, the ink I is guided to flow to the ink residual quantity sensor 31 through the downstream ink end sensor connecting flow passage 410.

The ink I guided to flow to the ink residual quantity sensor 31 is guided to flow from the ink discharging port 312, which is an outlet port of the cavity, to the ink guide path 420, which is formed on the rear side surface of the cartridge body 10, through the cavity (flow passage) within the liquid residual quantity sensor 31.

Since the ink guide path 420 is formed obliquely upward from the liquid residual quantity sensor 31 so as to allow the ink I to flow upward, the ink guide path 420 is connected to the ink inflow port 431 that communicates with the buffer chamber 430. Accordingly, the ink I that comes out of the ink residual quantity sensor 31 is guided to flow into the buffer chamber 430 through the ink guide path 420.

The buffer chamber 430 is a small room that is partitioned by the rib 10*a* between the upper ink containing chamber 370 and the lower ink containing chamber 390 and serves as a space for storing the ink immediately before the differential pressure valve 40. The buffer chamber 430 is formed so as to be opposite to the rear side of the differential pressure valve 40. Accordingly, the ink I flows to the differential pressure valve 40 through the ink guide path 440 that communicates with the ink discharging port 432 formed in the recess 434 of the buffer chamber 430.

The ink I that flows to the differential pressure valve 40 is guided to flow to the downstream by the differential pressure valve 40, and then is guided to an outlet flow passage 450 through a through-hole 451. Since the outlet flow passage 450 communicates with the ink supply port 50, the ink I is supplied to the ink jet printing apparatus through the ink supply needle 240 inserted into the ink supply port 50.

In the ink cartridge 1, as shown in FIG. 8, the non-containing chamber 501 that does not contain the ink I is portioned on the front side surface of the cartridge body 10, in addition to the ink containing chambers (the upper ink containing chamber 370 and 390 and the buffer chamber 430), the air chambers (the ink trap chamber 340 and the connecting buffer 350), and the ink guide paths (the upstream ink end sensor connecting flow passage 400 and the downstream ink end sensor connecting flow passage 410) described above.

When viewed from the front side surface of the cartridge body 10, the non-containing chamber 501 is partitioned in an area close to the hatched left side surface so as to be sandwiched between the upper ink containing chamber 370 and the lower ink containing chamber 390.

In addition, in the non-containing chamber 501, an air introducing hole 502 that is holed through the rear side surface is provided at the left upper corner in the inner area thereof so as to communicate with open air through the air introducing hole 502.

When the ink cartridge 1 is depressurized and then packed, the non-containing chamber 501 serves as a deaerating chamber in which a deaerating negative pressure is accumulated.

Next, the air communicating path 150 from the air introducing hole 100 to the upper ink containing chamber 370 will be described with reference to FIGS. 8 to 12.

When an inner pressure of the ink cartridge 1 is reduced with a consumption of the ink I in the ink cartridge 1, air (gas) flows from the air introducing hole 100 to the upper ink containing chamber 370 as much as a reduction amount of the stored ink I.

A small hole 102 that is provided in the air introducing hole 100 communicates with an one end of a meandering passage 310 formed on the rear side surface of the cartridge body 10. The meandering passage 310 is a meandering path that is formed lengthwise, and extends from the air introducing hole 100 to the upper ink containing chamber 370 to prevent moisture of ink from evaporating. Further, the other end thereof is connected to the gas-liquid separating filter 70.

A through-hole 322 is formed on a bottom surface of the gas-liquid separating chamber 70*a* that constitutes the gas-liquid separating filter 70, and communicates with a space 320 formed on the front side surface of the cartridge body 10 through the through-hole 322.

In the gas-liquid separating filter 70, the gas-liquid separating film 71 is disposed between the through-hole 322 and the other end of the meandering passage 310. The gas-liquid separating film 71 has a meshed shape and is made of a textile material that has a high water repellent property and high oil repellent property.

The space 320 is formed on the right upper portion of the upper ink containing chamber 370 when viewed from the front side surface of the cartridge body 10. In the space 320, a through-hole 321 opens above the through-hole 322. The space 320 communicates with an upper connection flow passage 330 formed on the rear side surface through the through-hole 321.

The upper connection flow passage 330 has partial flow passages 333 and 337. The partial flow passage 333 extends from the through-hole 321 along the long side in the right direction, when viewed from the rear side surface so as to pass through the uppermost surface of the ink cartridge 1, that is, the uppermost portion from the gravity direction in a state where the ink cartridge 1 is mounted. The partial flow passage 337 reverses in a reverse portion 335 at the vicinity of the short side, passes through the upper surface of the ink cartridge 1, and extends up to a through-hole 341 formed at the vicinity of the through-hole 321. Further, the through-hole 341 communicates with the ink trap chamber 340 formed on the front side surface.

When the upper connection flow passage 330 is viewed from the rear side surface, a position 336 in which the through-hole 341 is formed and a concave portion 332 which is caved more deeply than the position 336 in the thicknesswise direction of the ink cartridge are provided in the partial flow passage 337 that extends from the reverse portion 335 to the through-hole 341. A plurality of ribs 331 are formed so that the concave portion 332 is partitioned. The partial flow passage 333 that extends from the through-hole 321 to the reverse portion 335 is formed so as to be shallower than the partial flow passage 337 that extends the reverse portion 335 to the through-hole 341.

In the exemplary embodiment, since the upper connection flow passage 330 is formed in the uppermost portion from the gravity direction, the ink I does not normally flow to the air introducing hole 100 beyond the upper connection flow passage 330. Moreover, the upper connection flow passage 330 has as a sufficiently wide thickness much as the ink I does not flow backward by the capillary phenomenon, and the concave portion 332 is formed in the partial flow passage 337. Accordingly, it is easy to catch the ink I that flows backward.

The ink trap chamber 340 is a rectangular parallelepiped space that is formed in a corner of the right upper portion of the cartridge body 10 when viewed from the front side surface. As shown in FIG. 12, the through-hole 341 opens to the vicinity of an inner corner of the left upper portion of the ink trap chamber 340 when viewed from the front side surface. Further, in a front corner of the right lower portion of the ink trap chamber 340, a notch 342 is formed in the manner that a part of the rib 10*a*, which serves as a wall, is notched. Accordingly, the ink trap chamber 340 communicates with the connecting buffer chamber 350 through the notch 342.

The ink trap chamber 340 and the connecting buffer chamber 350 are air chambers that are provided so as to expand a capacity of the way of the air communicating path 150. For this reason, even when the ink I flows backward from the upper ink containing chamber 370, the ink I remains in the ink trap chamber 340 and the connecting buffer chamber 350 so that the ink I does not flow into the air introducing hole 100 any more. The detailed role of the ink trap chamber 340 and the connecting buffer chamber 350 will be described below.

The connecting buffer chamber 350 is a space that is formed below the ink trap chamber 340. A depressurization hole 110 for extracting air when ink is injected is provided on the bottom surface 352 of the connecting buffer chamber 350. The through-hole 351 opens in the thicknesswise direction in the vicinity of the bottom surface 352 and in the lower portion in the downmost gravity direction when mounted on the ink jet printing apparatus. Accordingly, through the through-hole 351, the connecting buffer chamber 350 communicates with a narrow communicating passage 360 formed on the rear side surface.

A narrow communicating passage 360 constitutes a part of the air communicating path 150 allowing the upper ink containing chamber 370 to communicate with the air introducing hole 100. As shown in FIG. 10(*b*), the narrow communicating passage 360 extends middle-upward when viewed from the rear side surface, and communicates with the upper ink containing chamber 370 through the through-hole 372 that is opened in the vicinity of the bottom surface of the upper ink containing chamber 370.

The through-hole 372 at one end of the narrow communicating passage 360 serves as an air outflow port for introducing open air into the upper ink containing chamber 370 through the air communicating path 150. On the other hand, since the through-hole 351 at the other end of the narrow communicating passage 360 communicates with a connecting buffer chamber 350, the through-hole 351 serves as an air inflow port for introducing open air from the communicating buffer chamber 350 to the narrow communicating passage 360.

In the narrow communicating passage 360, the through-hole 372 that serves as the air outflow port at the one end of the narrow communicating passage 360 is provided in the vicinity of the bottom wall 375 (see FIG. 10(*a*)) of the upper ink containing chamber 370 on the uppermost stream side. On the other hand, the through-hole 351 that serves as the air inflow port at the other end of the narrow communicating passage 360 is provided lower than the bottom wall 375 of the upper ink containing chamber 370 by a distance H1.

Figure 14:
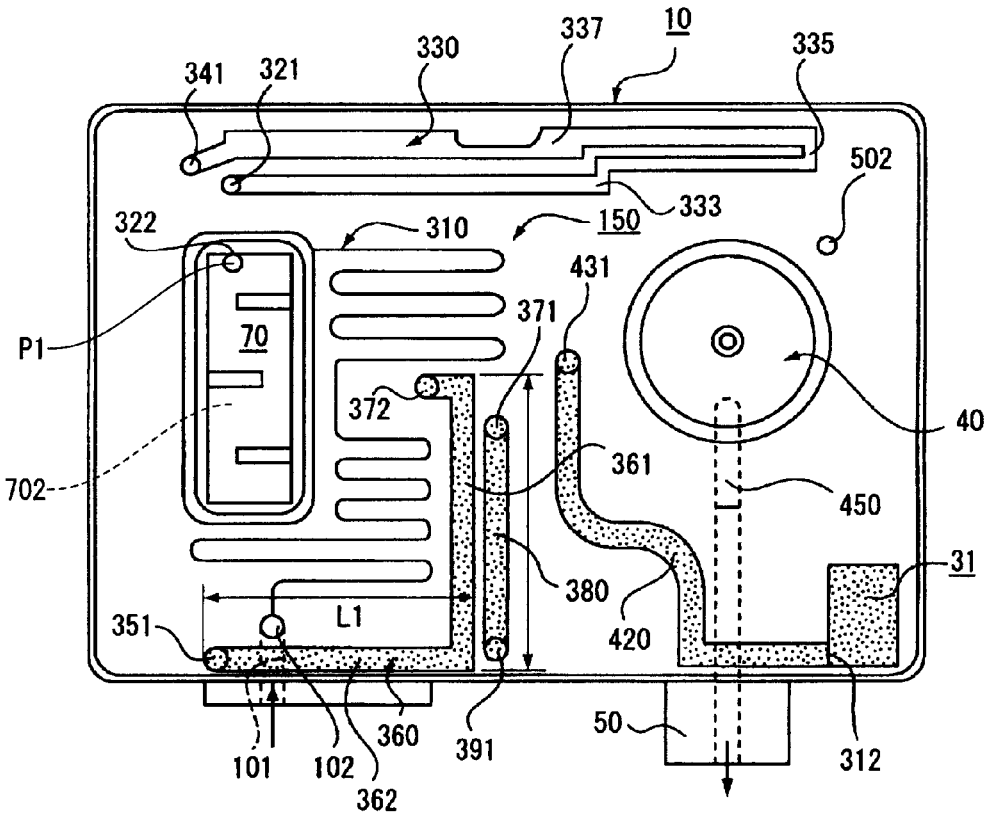
FIG. 14 is an explanatory view illustrating portions into which ink can be injected by the liquid injection method according to the invention in the configuration of the ink cartridge shown in FIG. 10(*b*).

As shown in FIGS. 10(*b*) and FIG. 14, the narrow communicating passage 360 is formed in an L shape by a first communicating path 361 that substantially vertically descends by the distance H1 from the through-hole 372 serving as the air outflow port, and a second communicating path 362 that substantially horizontally extends by a distance L1 from the lower end of the first communicating path 361 and communicates with the through-hole 351 serving as the air inflow port.

The narrow communicating passage 360 formed in the L shape by the first communicating path 361 and the second communicating path 362 is a communicating passage that is formed narrower in a sectional area than at least a part of other communicating passages constituting the air communicating path 150. The narrow communicating passage 360 keeps some of the ink I contained in the upper ink containing chamber 370 by a meniscus within the first communicating path 361 and the second communicating path 362.

The communicating path 360 is as narrow as the meniscus is formed in the all part thereof. Accordingly, even when the inner air of the upper ink containing chamber 370 expands or contracts due to a change in a temperature or the like and the liquid surface formed in the communicating path 360 moves, the meniscus can be formed in any part of the communicating path 360.

The length H1 of the first communicating path 361 and the distance L1 of the second communicating path 362 described above are set so that an amount of the ink kept within the narrow communicating passage 360 becomes an appropriate amount as much as the ink I contained in the upper ink containing chamber 370 can be blocked from the air of the outside.

In the above-described ink cartridge 1, since the ink is sealed in the air communicating path 150 by the ink I kept in the narrow communicating 360 provided therein, moisture of the ink contained in the upper ink containing chamber 370 does not evaporate from the air communicating path 150 to the outside. As a result, an increase in viscosity of the ink I caused by the moisture evaporation can be prevented. When an inner pressure of the upper ink containing chamber 370 drops with a consumption of the ink I in the upper ink containing chamber 370 in a state where the ink is sealed in the narrow communicating 360, air of the outside that is converted into very small bubbles passes through the sealed ink, and then is introduced into the upper ink containing chamber 370. At this time, the inner pressure of the upper ink containing chamber 370 returns to the atmospheric pressure. However, when the inner pressure of the upper ink containing chamber 370 does not drop, the air of the outside is not introduced.

That is, since the open air introduced into the ink containing chamber 370 through the air communicating path 150 is controlled as small as possible, deterioration in a quality of the ink I caused by a contact between the ink I and fresh air can be prevented.

As a result, the quality of the ink I contained in the ink containing chambers 370, 390, and 430 can be reliably maintained for a long time.

In the ink cartridge 1, the through-hole 372 that serves as the air outflow port at the one end of the narrow communicating passage 360 is provided in the vicinity of the bottom wall 375 of the upper ink containing chamber 370 while the through-hole 351 that serves as the air inflow port at the other end thereof is provided at a position lower than the bottom wall 375 of the upper ink containing chamber 370 by a distance H1.

For this reason, when a predetermined amount of the ink I is re-filled in the cartridge body 10 in, for example, in a factory, a liquid pressure of the ink I in the upper liquid containing chamber 370 applied to the air outflow port enables a necessary amount of the ink I to be sent to the narrow communicating passage 360 so as to keep the ink I. As a result, it is easy to form a liquid sealing portion in the air communicating path 150.

In the ink cartridge 1, since the narrow communicating passage 360 is formed in the L shape, the meniscus generated in the L-shaped bent acts on the ink I kept in the narrow communicating passage 360 so as to control the movement (backward flow) of the ink I. As a result, the ink I stored and kept in the narrow communicating passage 360 can be reliably sealed for a long time.

In the ink cartridge 1, the three ink containing chamber in one cartridge body are partitioned in one cartridge body, but three or more ink containing chambers can be arbitrarily equipped in the cartridge body. The more the ink containing chamber increases in number, the more multiple the bubble trap becomes. As a result, the control of the movement of the bubble B toward the downstream side can be enhanced.

Next, when the ink I in the above-described ink cartridge 1 is exhausted or lowered to a predetermined amount, a method of injecting the ink I into the used ink cartridge 1 according to an exemplary embodiment will be described with reference to FIGS. 13 and 14.

In the first place, a configuration of ink re-injecting apparatus used in an ink injecting method according to the exemplary embodiment will be described.

Figure 13:
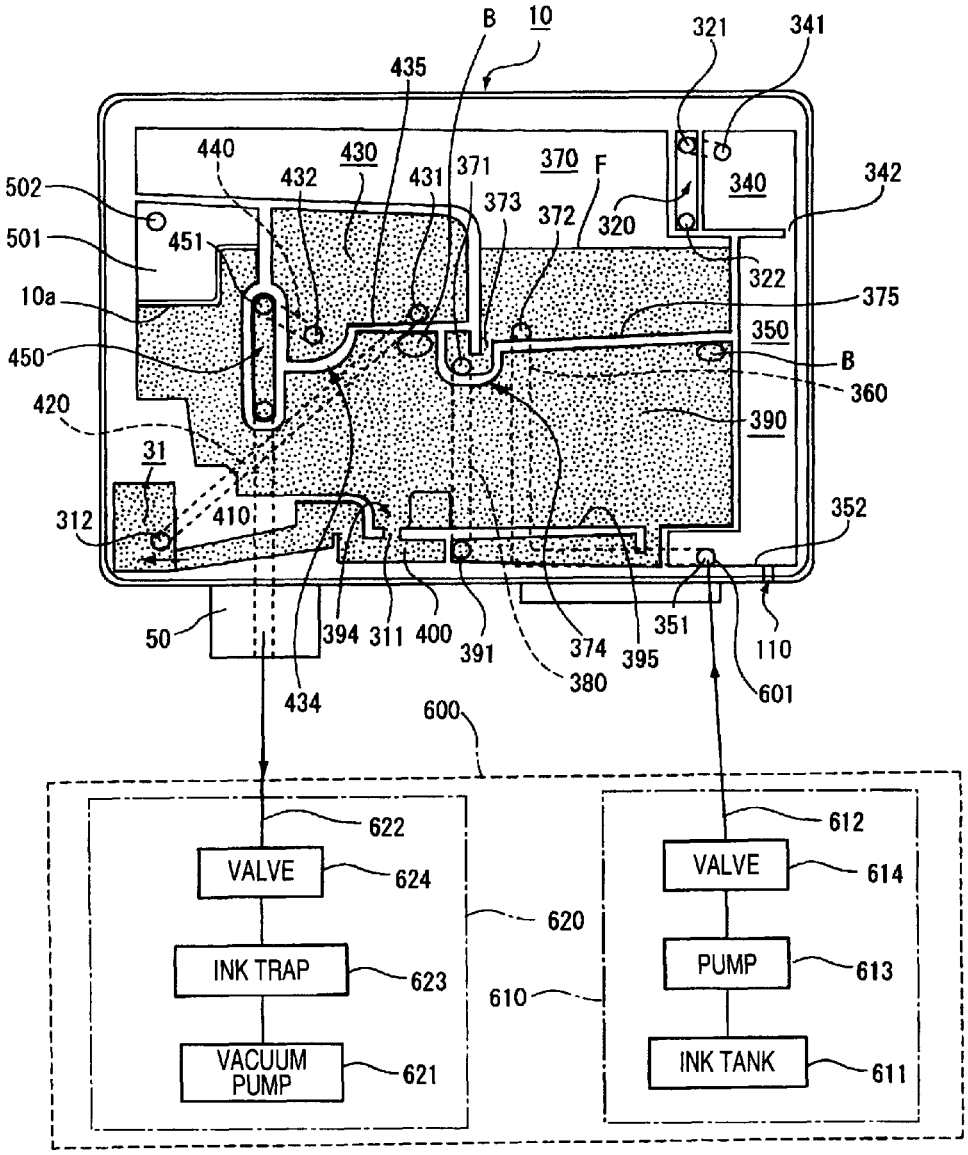
FIG. 13 is a block diagram illustrating a configuration of an ink re-injecting apparatus in which a method of injecting a liquid according to the embodiment of the invention is performed.

As shown in FIG. 13, an ink re-injecting apparatus 600 includes an ink injecting mechanism 610 connected to an injection port 601, which is opened by a punching process in the cartridge body 10, and a vacuum sucking mechanism 620 connected to the ink supply port 50 of the cartridge body 10.

The ink injecting mechanism 610 includes an ink tank 611 for storing the ink I to be re-filled, a pump 613 for sending the ink I stored in the ink tank 611 to a flow passage 612 connected to the injection port 601, and a valve 614 for opening/closing the flow passage 612 between the pump 613 and the injection port 601.

The vacuum sucking mechanism 620 includes a vacuum pump 621 for generating a negative pressure required for the vacuum sucking; a connecting flow passage 622 for allowing the negative pressure generated by the vacuum pump 621 to apply to the ink supply port 50; an ink trap 623 for being provided in the connecting flow passage 622, catching/collecting the ink I, which flows from the cartridge body 10 to the connecting flow passage 622 by the vacuum sucking, and protecting the vacuum pump 621 against ink mist or the like; and a valve 624 for opening/closing the connecting flow passage 622 between the ink trap 623 and the ink supply port 50.

In the embodiment, in consideration of a configuration or a function of the cartridge body 10, a position in which the injection port 601 is formed in the cartridge body 10 by a punching process is determined so that the injection port 601 communicates with the through-hole 351 that is positioned in the upstream end of the narrow communicating passage 360 constituting a part of the air communicating path 150.

The injection port 601 that communicates with the through-hole 351 is formed as follows.

First, the cover member 20 is removed from the ink cartridge 1, and a film 80 welded to the front side surface of the cartridge body 10 is exposed. The injection port 601 is formed so as to conform with the through-hole 351 by boring a hole through the film 80. In the front end portion of the flow passage 612 inserted into the injection port 601, for example, a sealing member or the like is pressed against the through-hole 351 and attached to the container wall surface of the circumference of the through-hole 351 so that the flow passage 612 is air-tightly connected to the narrow communicating passage 360.

The injection port 601 on the cartridge body 10 communicates with the air communicating path 150 on the more upstream side than the upstream end of the narrow communicating passage 360. However, the position in which the injection port 601 is equipped is not limited to the embodiment.

For example, as shown in FIG. 14, the position of the injection port 601 may be set to a position P1 that is opposite to a through-hole 322 opening to the gas-liquid separating chamber 70*a* that constitutes the gas-liquid separating filter 70. In this case, the gas-liquid separating film 71 constituting the gas-liquid separating filter 70 is removed to allow a flow passage 612 to be connected to the through-hole 322.

According to the embodiment, the used ink cartridge 1 is recovered to a reusable ink cartridge (liquid container) by, first, an injection port forming step of opening the injection port 601, which communicates with the air communicating path 150 on the more upstream side than the upstream end of the narrow communicating passage 360, in the cartridge body 10; a vacuum sucking step of sucking and removing the residual ink and residual air remaining in the inside through the ink supply port 50 by the vacuum sucking mechanism 620; a liquid re-filling step of injecting a predetermined amount of the ink I from the injection port 601 by the ink injecting mechanism 610; and a sealing step of sealing the injection port 601 after finishing the liquid re-filling step.

In the above-described vacuum sucking step and the liquid re-filling step, a step of maintaining the depressurization state is performed therebetween after the vacuum sucking step is performed, and a step of continuing to re-fill the liquid may be performed.

Moreover, in the course of the vacuum sucking step, the step of re-filling the liquid may be performed. Alternatively, while performing the vacuum sucking step is being performed, the liquid re-filling step may be performed.

Specifically, in the liquid re-filling step, when the vacuum sucking step starts, an opening/closing valve 614 is made closed so that the flow passage 612 is opened in synchronization with the vacuum sucking step before the liquid is injected from the injection port 601 of the liquid injecting mechanism 610. Afterward, the opening/closing valve 614 is made closed, and the following cases may be performed: 1. the case where the vacuum sucking step and the ink re-filling step are subsequently performed, 2. the case where the vacuum sucking step and the ink re-filling step are partially overlapped, 3. the case where the vacuum sucking step is substantially synchronized with the liquid re-filling step, or the like. In this way, the liquid refilling can be carried out in a short time since the intake of air extremely decreases. As a result, the quality of the recovered cartridge is not damaged.

Moreover, when the ink to be re-filled is maintained to a high degree of deaeration (that is, a ratio of the dissolved air or the dissolved gas is small), the vacuum sucking mechanism 620 is controlled so that a speed of the ink injection is lowered in the liquid re-filling step. Accordingly, since the liquid having less bubbles can be injected, the quality of the recovered cartridge is not damaged.

Specifically, the sealing step is a treatment step of air-tightly sealing the injection port 601 by means of attaching, welding, or the like of a sealing film. In addition, it may be difficult to air-tightly seal the injection port 601 by means of the attachment, welding, or the like of the sealing film due to a state of a cartridge when the cartridge is collected or a state of the injection port 601 when the cartridge is recovered. In this case, besides the film capable of air-tightly sealing the injection port 601, other sealing materials (a soft resin material, an adhesive material, and the like) can be used as well.

Moreover, a packing step of packing the recovered cartridge after finishing the sealing step by using an air-blocking material (air-blocking film, air-blocking metal material, or aluminum material, and the like) may be added. The recovered ink cartridge that is manufactured in this way is not affected by a distribution environment until it is delivered to customers. Accordingly, the recovery quality can be maintained more reliably. Further, since the recovered cartridge is packed in a state where the air within the pack made of the air-blocking material is deaerated, the recovery quality can be maintained more reliably.

In the above-described embodiment, the steps performed to inject the ink I into the cartridge body 10 are constituted by the steps of opening the injection port 601 so that the injection port 601 communicates with the air communicating path 150 on the more upstream side than the upstream end of the narrow communicating passage 360, re-filling the ink I, and sealing the injection port 601. The steps are all performed in a simple way. Accordingly, the processing cost is not expensive and it is not difficult to perform the steps.

In the exemplary embodiment, the vacuum sucking step of sucking and removing the residual ink and residual air remaining in the inside through the ink supply port 50 is provided. As a result, in the liquid injecting step of injecting the predetermined amount of the ink I from the injection port 601, the ink guide paths 380, 420, and 440 and the ink containing chambers of the cartridge body 10 are controlled under the depressurization environment, and thus all the ink guide paths including the ink supply port 50 as well as the ink containing chambers 370, 390, and 430 can effectively be refilled with the injected ink I.

Bubbles that are mixed when the ink I is injected can be extracted from the ink supply port 50 to the outside by means of the vacuum sucking, or inflow bubbles can be dissolved/disappeared in the liquid under the depressurization environment in the container formed by means of the vacuum sucking.

Accordingly, the bubbles that are mixed when the ink I is injected does not float in the ink containing chambers or the ink guide path, or are not attached to the wall surface of the flow passage. Further, there is no inconvenience like, for example, an abnormal operation of the liquid residual quantity sensor due to the remaining bubbles in the vicinity of a detecting unit of the liquid residual quantity sensor.

Since the injection port 601 is positioned in the upstream side of the narrow communicating passage 360 that is a part of the air communicating path 150, ink can be injected into the narrow communicating passage 360.

The re-filled ink in the narrow communicating passage 360 among the air communicating path 150 blocks the ink contained in the ink containing chamber 370 from the open air in the air communicating 150. Accordingly, since the ink I contained in the ink containing chamber 370 is out of contact with the open air as much as possible, the ink I can be prevented from being deteriorated. The functions (function of preventing moisture of the stored ink from being evaporated, and the like) carried out by the narrow communicating passage 360 can be also recovered like the new manufactured liquid container.

That is, according to the above-described configuration, when the ink is injected into the used ink cartridge 1, the steps performed in the cartridge body 10 may be simple. Moreover, the liquid can be injected without damaging the original function of the ink cartridge 1, and thus the used ink cartridge 1 can be used at a low price.

When such an ink cartridge is provided, the expected life span of the liquid container of the ink cartridge becomes longer. Accordingly, the resources can be saved and the environmental pollution can be prevented. Further, since a cost required for the re-filling is inexpensive, and the ink cartridge is provided at a low price, a running cost for the ink jet printer can be reduced.

The ink re-injecting apparatus 600 used in the embodiment may be substituted by an apparatus that can be easily obtained.

For example, the ink injecting mechanism 610 may be substituted by an injecting apparatus constituted by a cylinder and a piston like a syringe, or may be substituted by a supplementary bottle containing supplementary ink in a deformable pet bottle.

The liquid container according to the invention is not limited to the above-described ink cartridge of the ink jet printer. The liquid consuming device having a container-attached portion on which the liquid container according to the invention is not limited to the ink jet printer according to the embodiment.

The liquid consuming device corresponds to various devices which include the container-attached portion to which the liquid container is detachably attached to, and to which the liquid contained in the liquid container are supplied. Specific examples of the liquid consuming device include a device having a color material ejecting head used for manufacturing a color filter such as a liquid crystal display, a device having an electrode material (conductive paste) ejecting head used for forming an electrode such as an organic EL display, and a field emission display (FED), a device having a bioorganic matter ejecting head used for manufacturing a biochip, a device having a sample ejecting head used for a precision pipette, and the like.

The entire disclosure of Japanese Patent Application Nos. 2006-220755 filed on Aug. 11, 2006 and 2006-220763 filed on Aug. 12, 2006 are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A method of injecting a liquid into a liquid container detachably mounted on a liquid consuming device, the method comprising:

preparing the liquid container comprising:

a liquid containing chamber containing the liquid;

a liquid supply port connectable to the liquid consuming device;

a liquid guide path for guiding the liquid contained in the liquid containing chamber to the liquid supply port;

an air communicating path communicating the liquid containing chamber with air and having a communicating passage portion that is narrower than at least a part of other communicating paths in the air communicating path and can store some liquid contained in the liquid containing chamber by a meniscus; and a liquid residual quantity sensor provided in the liquid guide path and for outputting different signals between in a case where the liquid guide path is filled with the liquid and in a case where the liquid guide path includes air entered thereinto, wherein the liquid contained in the liquid containing chamber can be blocked from the air by the liquid stored in the communicating passage portion;

forming an injection port on a more upstream side than an upstream end of the communicating passage portion;

injecting a predetermined amount of liquid from the injection port; and sealing the injection port after injecting the liquid.

2. The method according to claim 1, further comprising depressurizing an inside of the liquid containing chamber.

3. The method according to claim 2, wherein the inside of the liquid containing chamber is depressurized through the liquid supply port.

4. A liquid container detachably mounted on a liquid consuming device, the liquid container comprising:

a liquid containing chamber containing a liquid;

a liquid supply port connectable to the liquid consuming device;

a liquid guide path for guiding the liquid contained in the liquid containing chamber to the liquid supply port;

an air communicating path communicating the liquid containing chamber with air and having a communicating passage portion that is narrower than at least a part of other communicating paths in the air communicating path and can store some liquid contained in the liquid containing chamber by a meniscus; and a liquid residual quantity sensor provided in the liquid guide path and for outputting different signals between in a case where the liquid guide path is filled with the liquid and in a case where the liquid guide path includes air entered thereinto, wherein the liquid contained in the liquid containing chamber can be blocked from the air by the liquid stored in the communicating passage portion, and wherein an injection port is formed on a more upstream side than an upstream end of the narrow communicating passage portion, a predetermined amount of liquid is injected from the injection port, and the injection port is sealed after injecting the liquid.

5. The liquid container according to claim 4, wherein an air outflow port at one end of the communicating passage portion is provided adjacent to a bottom wall of the liquid containing chamber and an air inflow port at the other end thereof is provided lower than the bottom wall of the liquid containing chamber.

6. The liquid container according to claim 4, wherein the communicating passage portion is formed in a substantial L shape.

7. The liquid container according to claim 4, further comprising a differential pressure valve which is disposed in the liquid flow passage, which is normally urged to be a closed state, and which is changed from the closed state to an opened state when a differential pressure between a side of the liquid supply portion and a side of the liquid containing portion is equal to or more than a predetermined value.

8. A liquid container detachably mounted on a liquid consuming device, the liquid container comprising:

a liquid containing chamber containing a liquid;

a liquid supply port for supplying the liquid to an outside;

a liquid guide path communicating the liquid containing chamber and the liquid supply port with each other;

an air communicating path communicating the liquid containing chamber with air and having a communicating passage portion that is directly connected to the liquid containing chamber and can store some liquid contained in the liquid containing chamber by a meniscus;

a liquid residual quantity sensor provided in the liquid guide path and for outputting different signals between in a case where the liquid guide path is filled with the liquid and in a case where the liquid guide path includes air entered thereinto;

a film member forming at least a part of the air communication path; and a sealing portion at which an injection port formed on the film and positioned on a more upstream side than an upstream end of the communicating passage portion is sealed, wherein the liquid contained in the liquid containing chamber can be blocked from the air by the liquid stored in the communicating passage portion.

9. The liquid container according to claim 8, wherein the sealing portion is formed by a film or an adhesive material.

* * * * *